US006077351A

United States Patent [19]

Herzog

[11] Patent Number: 6,077,351

[45] Date of Patent: Jun. 20, 2000

[54] COATING POROUS CARRIERS

[75] Inventor: Peter Herzog, Lausanne, Switzerland

[73] Assignee: Bematec SA, Switzerland

[21] Appl. No.: 09/082,818

[22] Filed: May 21, 1998

[30] Foreign Application Priority Data

May 27, 1997 [DE] Germany ..... 197 22 117

[51] Int. Cl.[7] ..... B05C 3/02

[52] U.S. Cl. ..... 118/414; 118/413; 118/419

[58] Field of Search ..... 118/414, 212, 118/117, 122, 413

[56] References Cited

U.S. PATENT DOCUMENTS

| | | | |
|---|---|---|---|
| 4,180,541 | 12/1979 | Gabrielli | 264/171 |
| 4,465,015 | 8/1984 | Osta et al. . | |
| 4,765,272 | 8/1988 | Mladota | 118/410 |

FOREIGN PATENT DOCUMENTS

| | | |
|---|---|---|
| 055867 | 7/1982 | European Pat. Off. . |
| 056067 | 7/1982 | European Pat. Off. . |
| 091147 | 10/1983 | European Pat. Off. . |
| 453427 | 10/1991 | European Pat. Off. . |
| OS 1577669 | 4/1970 | Germany . |
| 2034203 | 6/1980 | Germany . |
| 32 10 074 | 11/1982 | Germany . |
| 3100101 | 10/1983 | Germany . |
| 34 38 643 | 5/1985 | Germany . |
| 3922535 | 2/1990 | Germany . |
| 94 16 951 U | 1/1995 | Germany . |
| 296 21 876 U | 3/1997 | Germany . |

*Primary Examiner*—Brenda A. Lamb
*Attorney, Agent, or Firm*—Fitch, Even, Tabin & Flannery

[57] ABSTRACT

The invention relates to an apparatus for applying, by means of a slotted nozzle device formed between a stationary incoming nozzle lip and a trailing nozzle lip, a thin layer of coating material to a porous material web that passes over a counterpressure roll, wherein a doctor bar with an essentially circular cross-sectional shape is disposed on the trailing nozzle lip; this doctor bar has on its periphery at least one flattened section that runs across the entire longitudinal extension of the doctor bar and is rotatably supported within a doctor support so that the flattened section is adjustable at a setting angle relative to the counterpressure roll.

16 Claims, 2 Drawing Sheets

COATING POROUS CARRIERS

TECHNICAL FIELD

The invention relates to an apparatus for applying a thin layer of coating material onto a porous material web.

PRIOR ART

The types of coating apparatus already known are ones in which a slotted nozzle device is used to provide a material web, which passes over a counterpressure roll and is for example made of paper, plastic, woven fabric material, metal foil or a combination of these materials, on one side with a layer of coating material, such as hot melts, high-viscosity adhesives, paraffins and microcrystalline waxes or the like. The coating material, having emerged from a nozzle slot formed between a stationary incoming nozzle lip and a trailing nozzle lip of the slotted nozzle device, is applied directly to the surface of the continuous material web via a doctor bar formed in the trailing nozzle lip, with the material web being supported on a revolving support face during application.

An apparatus of the above class with a slotted nozzle device for applying a thin layer of coating material onto a material web passing over a counterpressure roll is known from the Applicant's patent DE-C-31 00 101; a doctor bar that can be rotated within a doctor support is formed in the trailing nozzle lip of this apparatus. The doctor bar is pressed into the doctor support by an adjusting device's resilient means for the purpose of sensitively adjusting the distance from the counterpressure roll along the width of the material web to be coated. In this way a predetermined, even thickness of the layer of coating material can always be applied to an impervious material web across the width of the web.

Due to the geometrical conditions of this apparatus, however, it is difficult to use the existing adjusting device to vary with sufficient sensitivity a pressure that acts upon the coating material substance between the doctor bar and material web or counterpressure roll during continuous operation. The penetration depth of a substance to be applied to a porous material web cannot, as a result, be flexibly metered. The counterpressure roll's convexity—by interacting with the doctor bar's curvature which makes contact therewith—causes a spontaneous rise in the pressure that acts upon the coating material substance between the counterpressure roll and doctor bar, producing a considerable component of compressive force directed against the material web. If porous material webs are used, the coating material therefore almost completely penetrates into the material web. Although the value of the component of compressive force against the material web can be reduced by using the existing adjusting device to increase the gap between the doctor bar and counterpressure roll, the coating material's penetration depth is also decreased. Such an adjustment of the gap between the doctor bar and counterpressure roll is, moreover, so critical that the pressure across the width of the web collapses to an extent, thus resulting in uncoated sections on the material web.

DEPICTION OF THE INVENTION

The textile industry and manufacturers of medical bandages or felt-coated roofing do, however, require coating devices in which the coating material substance to be applied can be metered onto porous material webs such that it rests on top, thus making it possible, by way of suitable measures, to define the penetration depth into the at least partially pervious, porous material web. At the same time, a sufficient adhesion of the coating material, e.g. adhesive, is to be ensured on the material web side to be coated and a breakthrough to the back of the material web is to be avoided.

The invention's technical problem is therefore to extend an apparatus of the aforementioned type such that the pressure that acts upon the coating material substance between doctor bar and counterpressure roll and hence the metering of the coating material's penetration depth into the material web surface can be easily and effectively adjusted and defined while the coating device is in continuous operation.

This object is solved by an apparatus according to the invention having the features of claim 1.

According to the invention, a doctor bar with an essentially circular cross-sectional shape is disposed on the trailing nozzle lip of a slotted nozzle device; this doctor bar has on its periphery at least one essentially flattened section running across the blade member's entire longitudinal extension and is rotatably supported within a doctor support so that the flattened section is adjustable at a setting angle relative to the counterpressure roll. Designing the doctor bar in this way produces the major advantage over the known types of apparatus that the hydraulic pressure acting upon the substance in the gap between the doctor bar and counterpressure roll can be regulated as a result of a simple structural feature. Precise adjustments of the doctor bar's flattened section to the material web that passes over the counterpressure roll can be achieved by rotating the doctor bar around its longitudinal axis so that the metering and hence penetration depth of the coating material into the porous material web can be defined in a simple and flexible manner by varying the flattened section's setting angle relative to the counterpressure roll. The steeper the flattened section's setting angle is adjusted relative to the counterpressure roll, the deeper the extent to which the coating material is introduced into the porous material web.

To rotate the doctor bar around its longitudinal axis, at least one rotary mechanism is also provided according to the invention. This rotary mechanism can be a mechanical, electrical, hydraulic or pneumatic device or the like. For example, a leverbar moved by an actuator and connected to the doctor bar is conceivable as a rotary mechanism in its simplest embodiment.

The doctor bar can be easily produced and replaced for every desired width of coating and web.

The doctor bar is preferably made of steel and the counterpressure roll coated with an elastic material such as vulcanite, rubber or the like. A steel roll can also be used as a counterpressure roll if the material web to be coated exhibits sufficient elasticity.

Advantageous embodiments of the apparatus according to the invention are described in the other claims.

In certain applications, the doctor bar can be fixed at a predetermined setting angle $\alpha$. In this way, the penetration depth can be precisely adjusted to a specific extent across the entire material web length and kept constant.

The doctor support is preferably a complementary, semi-cylindrical recess in the trailing nozzle lip relative to the essentially circular cross-sectional shape of the doctor bar. This layout ensures that the doctor bar is supported very securely and rigidly within the recess adapted to its profile. Highly viscous coating materials can also be easily processed in this way. Precise steady transfer rates from the slotted nozzle device to the material web to be coated are also achieved. The entire doctor support also remains filled up by the doctor bar's complete cross section and therefore stays sealed. The coating material therefore cannot run around the doctor bar and settle above the doctor bar at undesirable sites on the material web.

According to an advantageous embodiment of the invention, the doctor bar makes contact, by way of its circular portion that adjoins the flattened section, with the material web. This ensures an even distribution of the coating material on the material web without damaging the surface of the material web as a result of the adjacent doctor bar. This design enables extremely precise adaptations of the doctor bar to the counterpressure roll profile across the total width of the roll even when there may be unevennesses in the counterpressure roll. In this way, any production inaccuracies can also be almost compensated for.

In order to enable the counterpressure roll to remain unchanged in the apparatus at all times, a radial gap is preferably kept constant between the center of the counterpressure roll and the blade member's circular portion that adjoins the flattened section. This makes it unnecessary to perform a complicated re-adjustment of the entire apparatus structure, particularly of the counterpressure roll relative to the slotted nozzle device, for every desired material web coating depth. This allows the coating apparatus to be adapted as quickly as possible to altered conditions during operation; such an adaptation is alone brought about by a corresponding flexible adjustment of the doctor bar setting angle relative to the counterpressure roll.

In certain applications, it is beneficial to subdivide the flattened section into a plurality of partial sections along the doctor bar's longitudinal extension. The flattened partial sections are preferably recessed as segmental cutouts within the doctor bar periphery. The areas between adjacent flattened partial sections have the doctor bar's essentially circular cross-sectional shape and make contact with the material web that passes over the counterpressure roll. The segmental cutouts are preferably milled into the doctor bar's periphery. In principle, other cutout shapes can also be used, e.g. rectangular, polygonal, round, oval or curved cutout shapes. The attachment of such partial sections on the doctor bar makes it possible to form, across the entire web width, an arbitrary longitudinal and/or transverse contour of the coating material to be applied to the material web. The provision of partial sections creates an additional volume for the coating material to pass through, allowing the coating to be zonally influenced across the length of the doctor bar as well. As a result, the coating surface appearance can be varied at random. The ability to meter the material to be applied is therefore improved over the entire web width, thereby optimizing the quality of the applied material and obtaining an absolutely top-quality final product. The flattened partial sections can have various widths and distances from one another, making it possible to produce any desired contour on the porous material web. Sharp-edged contours are produced without marginal buildup as a result of the partial sections on the doctor bar according to the invention.

According to an extension of the invention, a sealing device is disposed in the nozzle slot in the areas between adjacent flattened partial sections. Areas of the incoming nozzle lip of the slotted nozzle formed as a wide slotted nozzle are advantageously designed as a sealing lip. Such a sealing device ensures that coating material is reliably prevented from emerging outside the material-web portions to be coated and that the desired contour is precisely achieved.

To guarantee that the apparatus according to the invention operates with minimum wear, the sealing device preferably comprises one or more polytetrafluoroethylene sealing members. The use of polytetrafluoroethylene as a particularly wear-resistant material with respect to smooth surfaces for the sealing device ensures that the counterpressure roll that makes contact with the areas between adjacent flattened partial sections operates practically without wear. As a result, parts of the apparatus affected by friction need to be replaced less frequently, which in the case of high production rates, contributes toward a cost-effective mode of production. In principle, however, other materials or combinations of materials are also conceivable for the sealing device.

It has also proved to be particularly advantageous to provide a gear pump in the apparatus for the purpose of hydraulically feeding the coating material into the nozzle slot. The use of such a prefabricated standard component contributes toward a simple and cost-effective production of the overall apparatus structure.

BRIEF DESCRIPTION OF THE DRAWINGS

Preferred exemplary embodiments of the invention with additional design details and other advantages will now be described and explained more closely with reference to the attached drawings.

DESCRIPTION OF THE INVENTION'S EXEMPLARY EMBODIMENTS

Figure 1:
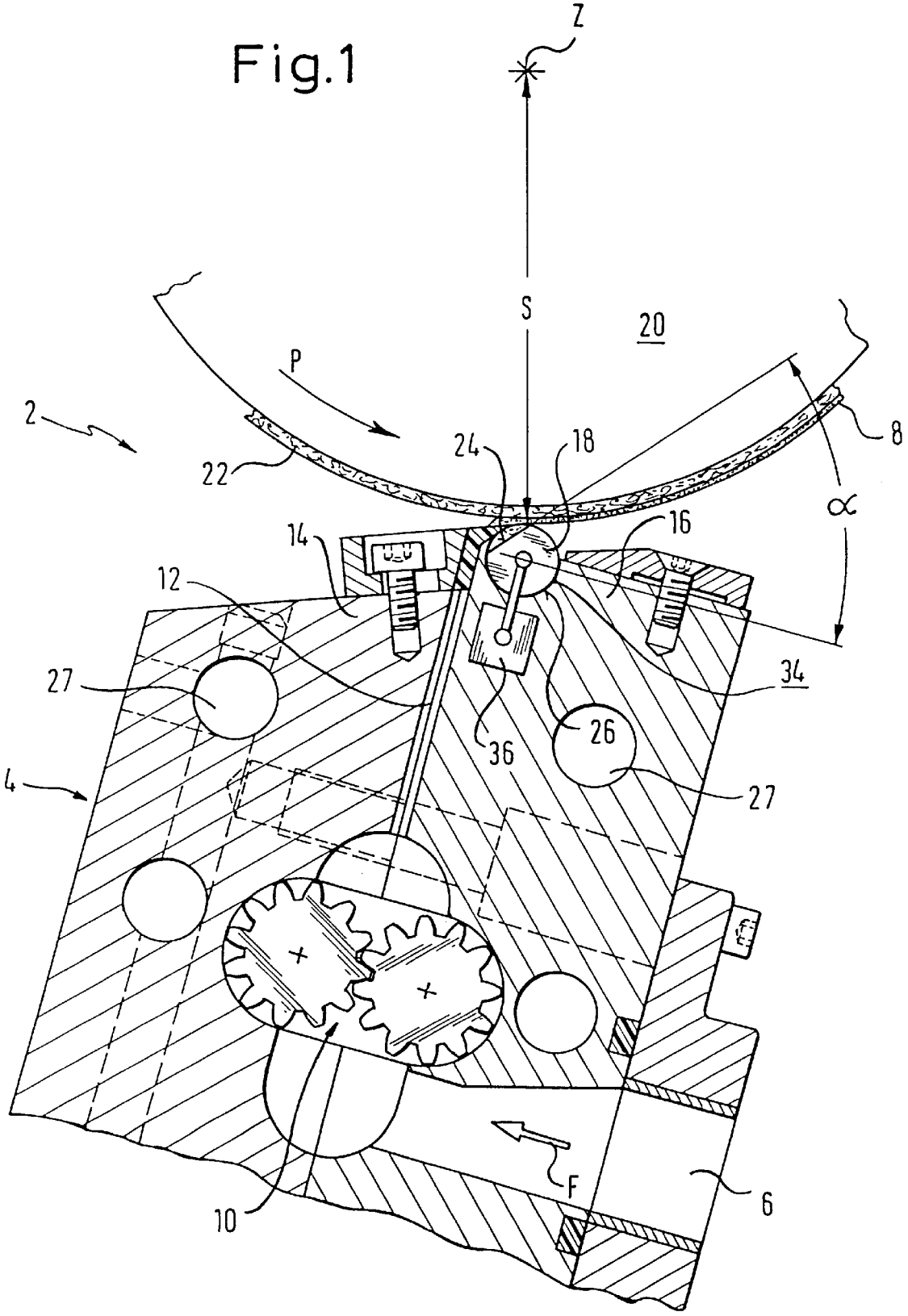
FIG. 1 shows a schematic cross-sectional representation of a coating apparatus according to the invention.

To avoid repetitions, identical parts or components will also be identified by the same reference numerals in the following description and in the drawings, unless it is necessary to draw further distinctions.

As shown in FIG. 1 in a schematic cross-sectional depiction, the coating apparatus 2 according to the invention comprises a slotted nozzle means 4 that extends across the entire width of the coating apparatus 2. A supply duct 6 for the coating material 8 to be applied is formed in the coating apparatus 2. A slotted-nozzle gap 12, connected via a gear pump 10 and formed between a stationary incoming nozzle lip 14 and a trailing nozzle lip 16, adjoins this supply duct 6. The feed direction of the coating material 8 is indicated in the drawing by arrow F.

A doctor bar 18 is disposed at the upper free end of the trailing nozzle lip 16. Opposite the coating apparatus 2 is a counterpressure roll 20 which acts as a support surface for a porous material web 22 for directly coating the coating material 8 to be applied. The direction of rotation of the counterpressure roll 20 is illustrated by arrow P.

In the present exemplary embodiment, the doctor bar 18 has an essentially circular cross section with a flattened section 24 that runs across the entire longitudinal extension of the doctor bar 18. It is held in a complementary recess 26 located in the upper region of the trailing nozzle lip 16 and which acts as a doctor support 34. The doctor bar 18 extends substantially across the entire width of the porous material web 22 that runs on the counterpressure roll 20. The recess 26 has a semicylindrical cross-sectional shape complementary to the circular peripheral portion of the doctor bar 18. The depth of the recess 26 is somewhat larger in the trailing nozzle lip 16 than the radius of the doctor bar 18. As a result, the entire doctor support 34 remains filled up by the circular portion of the doctor bar 18, so that the doctor bar 18 is rotatably supported around its longitudinal axis within the recess 26 in a manner that is free from play. The flattened section 24 of the doctor bar 18 is set and can be fixed at a setting angle a relative to the counterpressure roll 20.

For this purpose, an adjusting means (not shown in the drawing) is also provided; it is disposed on the doctor bar 18 via an actuator 36 and rotates and fixes the doctor bar 18 at a predetermined setting angle α. One possible exemplary embodiment of this kind of adjusting means is shown by the Applicant's aforementioned DE-C-31 00 101 in which a doctor bar securely connected to a linkage is oscillatingly driven via a geared motor. In principle, the adjusting means may relate to any adjusting mean suitable for the intended purpose and fitted with a mechanical, hydraulic, pneumatic or electrical rotary mechanism or the like. Whenever the adjusting means is actuated, the doctor bar 18 is rotated around its longitudinal axis such that its flattened section 24 is adjusted at a predetermined setting angle a relative to the counterpressure roll 20. By using the adjusting means to rotate the doctor bar 18, with the flattened section 24 being moved toward or away from the facing counterpressure roll, the amount of coating material 8 to be applied can be metered onto the opposite porous material web 22 and the penetration depth of the coating material 8 into the porous material web 22 can be defined. For the purpose of installment or dismantlement, the doctor bar 18 can be easily inserted into or removed from the recess 26.

As illustrated in FIG. 1, heating or cooling bores 27 are also provided in the incoming nozzle lip 14 and trailing nozzle lip 16, thereby improving heat transfer within the apparatus.

When operating the coating apparatus 2 according to the invention, the coating material 8 is first fed through a supply duct 6 and then arrives at the gear pump 10 that hydraulically feeds the coating material 8 into the slotted-nozzle gap 12 from which it then reaches and can penetrate into the opposite porous material web 22 via the set flattened section 24 of the doctor bar 18.

The radial distance S between the center Z of the counterpressure roll and a circular portion or a portion which is rounded off of the doctor bar 18 that adjoins the flattened section 24 is constant. The doctor bar 18 is rotated by the rotary mechanism (not shown) of the adjusting means in such a way that the circular portion adjoining the flattened section 24 easily makes contact with the material web 22, thus allowing the coating's penetration depth into the porous material web 22 to be defined during continuous operation via the setting angle α, and yet no friction worth mentioning is produced between the circular portion of the doctor bar 18 and the counterpressure roll 20.

Figure 2:
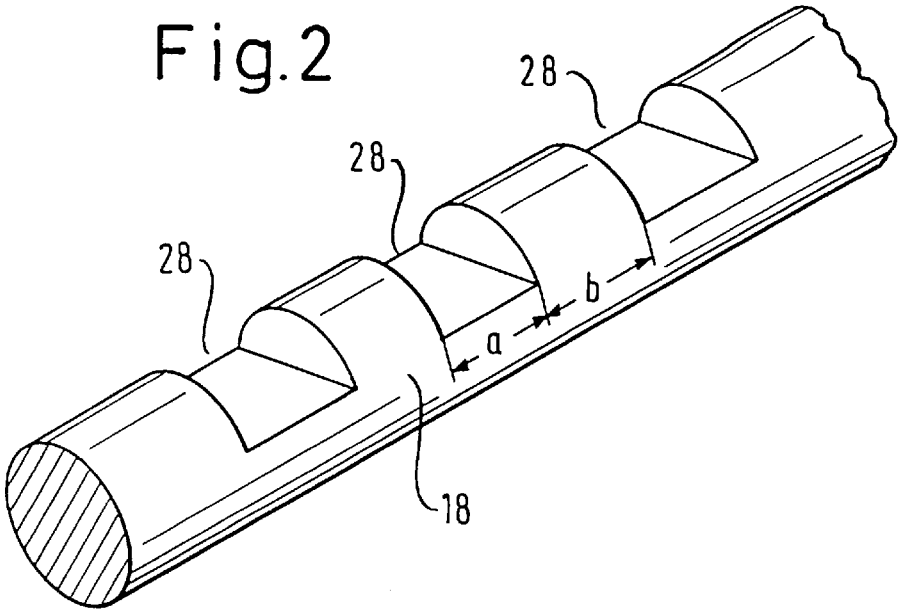
FIG. 2 shows a perspective view of a doctor bar of a second embodiment of the coating apparatus according to the invention.

FIG. 2 shows a perspective view of a doctor bar of a second embodiment of a coating apparatus according to the invention. The doctor bar 18 can be easily removed from the blade support according to FIG. 1 and replaced by the one shown in FIG. 2. This particular design version of the doctor bar 18 essentially corresponds to that according to FIG. 1, but with the difference that the flattened section 24 is subdivided into a plurality of partial sections 28 along the longitudinal extension of the doctor bar 18. The doctor bar 18 is subdivided along its longitudinal extension into a plurality of partial sections 28 in which the flattened section 24 is provided, respectively. Areas between the adjacent flattened partial sections 28 have the essentially circular cross section of the doctor bar 18. The partial sections 28 have different widths a and are each arranged in relation to one another at different distances b with the circular cross-sectional shape. In the present case, the flattened partial sections 28 are milled into the doctor bar 18.

During operation, the circular cross-sectional areas of the doctor bar 18 make contact with the counterpressure roll 20, the coating material 8 leaves the slotted-nozzle gap 12, passes through the spaces formed by the flattened partial sections 28 and encounters the facing material web 22. It is possible to produce a desired pattern, e.g. stripes in the present instance, on the material web.

Figure 3:
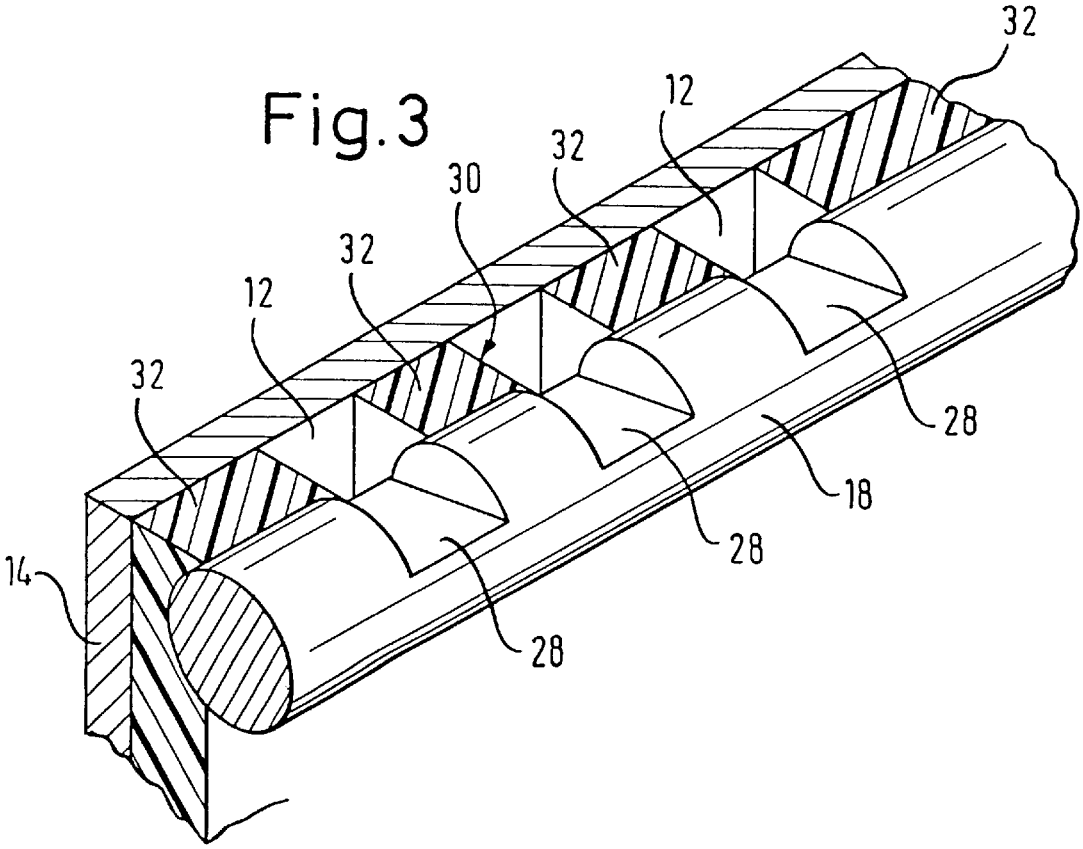
FIG. 3 shows a perspective view of a partial region of a third embodiment of a coating apparatus according to the invention.

As indicated in FIG. 3 in a perspective view of a partial region of a third embodiment of a coating apparatus according to the invention, the areas between adjacent flattened partial sections 28 are provided with a sealing means 30 disposed in the slotted-nozzle gap 12. The sealing means (30) is disposed in the nozzle slot 12 in the areas between adjacent flattened partial sections 28 and acts against the incoming nozzle lip 14 and the trailing nozzle lip 16. This particular design version essentially corresponds to that according to FIG. 1 and FIG. 2, but provides the sealing means 30. The sealing means 30 comprises a plurality of sealing members 32 which in the present instance are made of polytetrafluoroethylene. The sealing members 32 are formed between the incoming nozzle lip 14 and the trailing nozzle lip 16, making contact with the circular periphery of the doctor bar 18. This ensures that no coating material 8 emerges between the partial sections 28 and can be transferred to the material web 22, thus enabling a sharp-edged coating contour to be produced across the entire material web width. It is apparent that the recesses 26 in the doctor bar 18 may also have any other shape or size, making it possible to produce any desired pattern on the porous material web 22.

What is claimed is:

1. An apparatus for applying a thin layer of coating material to a porous material web comprising:

a counterpressure roll over which the porous material web passes;

a slotted nozzle formed between a stationary incoming nozzle lip and a trailing nozzle lip; and a rotatably adjustable doctor bar disposed on said trailing nozzle lip and having an essentially circular cross-sectional shape;

wherein said doctor bar has on its periphery at least one flattened section running essentially across its entire longitudinal extension effective for metering the amount of coating material that is applied to the web, wherein said doctor bar is rotatably supported within a doctor support, wherein said flattened section is rotatable adjustable at a setting angle α relative to said counterpressure roll.

2. An apparatus according to claim 1, wherein said doctor support is a recess in said trailing nozzle lip complementary to the essentially circular cross-sectional shape of said doctor bar.

3. An apparatus according to claim 1, wherein said doctor bar comprises a circular portion that adjoins said flattened section and makes contact with the material web.

4. An apparatus according to claim 3, wherein a radial distance (S) between a center (Z) of said counterpressure roll and that circular portion of said doctor bar which adjoins said flattened section is constant.

5. An apparatus according to claim 1, wherein said flattened section is subdivided into at least two partial sections along the longitudinal extension of said doctor bar.

6. An apparatus according to claim 5, wherein a sealing structure is disposed in a nozzle slot in the areas between adjacent flattened partial sections.

7. An apparatus according to claim 6, wherein said sealing structure comprises one or more polytetrafluoroethylene sealing members.

8. An apparatus according to claim 1, wherein said apparatus comprises a gear pump for feeding the coating material into said nozzle slot.

9. An apparatus for applying a thin layer of coating material to a porous material web comprising:

a counterpressure roll over which the porous material web passes;

a slotted nozzle formed between a stationary incoming nozzle lip and a trailing nozzle lip; and a doctor bar disposed on said trailing nozzle lip and having an essentially circular cross-sectional shape, wherein said doctor bar has on its periphery at least one flattened section running essentially across its entire longitudinal extension effective for metering the amount of coating material that is applied to the web, wherein said flattened section is fixable at a setting angle $\alpha$ relative to said counterpressure roll.

10. An apparatus according to claim 9, wherein said doctor support is a recess in said trailing nozzle lip complementary to the essentially circular cross-sectional shape of said doctor bar.

11. An apparatus according to claim 9, wherein said doctor bar comprises a circular portion that adjoins said flattened section and makes contact with the material web.

12. An apparatus according to claim 11, wherein a radial distance (S) between a center (Z) of said counterpressure roll and that circular portion of said doctor bar which adjoins said flattened section is constant.

13. An apparatus according to claim 9, wherein said flattened section is subdivided into at least two partial sections along the longitudinal extension of said doctor bar.

14. An apparatus according to claim 13, wherein a sealing structure is disposed in a nozzle slot in the areas between adjacent flattened partial sections.

15. An apparatus according to claim 14, wherein said sealing structure comprises one or more polytetrafluoroethylene sealing members.

16. An apparatus according to claim 9, wherein said apparatus comprises a gear pump for feeding the coating material into said nozzle slot.

* * * * *